US005760799A

United States Patent [19]

Inui et al.

[11] Patent Number: 5,760,799

[45] Date of Patent: Jun. 2, 1998

[54] INK JET PRINTER AND METHOD OF ADJUSTING THE SAME

[75] Inventors: Tetsuya Inui, Nara; Hirotsugu Matoba, Sakurai; Susumu Hirata, Ikoma-gun; Yorishige Ishii, Yamatotakada; Shingo Abe, Tenri; Masaharu Kimura, Daito; Hajime Horinaka, Kashiba; Hiroshi Onda, Yamatokoriyama, all of Japan

[73] Assignee: Sharp Kabushiki Kaisha, Osaka, Japan

[21] Appl. No.: 625,901

[22] Filed: Apr. 1, 1996

[30] Foreign Application Priority Data

Apr. 7, 1995 [JP] Japan ..... 7-082426

[51] Int. Cl.[6] ..... B41J 2/05

[52] U.S. Cl. ..... 347/14

[58] Field of Search ..... 347/14, 57, 194, 347/19, 185, 186

[56] References Cited

U.S. PATENT DOCUMENTS

| | | | |
|---|---|---|---|
| 4,973,984 | 11/1990 | Sasaki | 347/182 |
| 5,122,816 | 6/1992 | Poeppel | 347/211 |
| 5,331,340 | 7/1994 | Sukigara | 347/14 |
| 5,559,535 | 9/1996 | Otsuka et al. | 347/14 |
| 5,559,547 | 9/1996 | Hagar | 347/211 |
| 5,576,745 | 11/1996 | Matsubara | 347/14 |
| 5,644,351 | 7/1997 | Masumoto et al. | 347/194 |

FOREIGN PATENT DOCUMENTS

| | | |
|---|---|---|
| 0569201 A1 | 11/1993 | European Pat. Off. . |
| 3730110 A1 | 3/1989 | Germany . |
| 7-309832 | 11/1993 | Japan . |

*Primary Examiner*—Adolf Berhane
*Attorney, Agent, or Firm*—Nixon & Vanderhye P.C.

[57] ABSTRACT

An ink jet printer performs a control of a supply of electric power for each heating element based on a temperature dependency of a resistance value by monitoring its resistance value while ink is being discharged. Accordingly, the ink jet printer permits a damage of the heating element and a discharge inferior caused by a difference in characteristics in heating elements, ambient temperature, etc., to be suppressed. Additionally, as the temperature of the heating element is not detected directly, the ink jet printer permits high speed control of the electric value, thereby permitting high speed printing.

16 Claims, 13 Drawing Sheets

INK JET PRINTER AND METHOD OF ADJUSTING THE SAME

FIELD OF THE INVENTION

The present invention relates to an ink jet printer for printing on a printing material by discharging thereon an ink and also relates to a method of adjusting such ink jet printer.

BACKGROUND OF THE INVENTION

An ink jet printer performs a printing operation on a printing material such as a sheet, an OHP sheet, etc., by activating plural ink jet head driving devices so as to discharge liquid ink from plural ink jet head elements. Such ink jet head elements are generally classified into two types: a bubble jet type wherein a heat is applied to the ink to boil it, so that the ink is discharged using the resulting bubble, and a buck ring jet system wherein a fine buckling member is heated and buckled to urge the ink to be discharged.

These ink jet head elements are arranged such that electric power in the form of pulse is applied to the corresponding heating elements from the ink jet driving devices so as to rapidly increase the temperature of the ink or a buckling member, etc., thereby discharging the ink. However, such method has the following drawbacks. That is, as the heat is applied so abruptly, an insufficient heating or overheating may occur depending on an ambient temperature, differences in characteristics of the heating elements, differences in characteristics of the drive circuits, etc. For example, when the ambient temperature is high, if a constant electric power is kept applying to the heating elements, overheating would occur which may damage the heating elements. On the contrary, when the ambient temperature is low, an insufficient heat may be applied to the heating elements, which would cause a printing failure, or reduction in size of the recording dot.

As a solution to the described problem, an ink jet head driving device wherein an ambient temperature is measured so as to adjust the electric power to be applied to the heating elements based on the result obtained from the measurement has been proposed. However, in such ink jet head driving device, the difference in characteristics of the heating elements cannot be adjusted.

To overcome the described problem, an ink jet head driving device known, for example, through Japanese Laid-Open Patent Application No. 125587/1978 (Tokukaisho 53-125587) has been proposed wherein a temperature of the heated portion is detected so as to adjust the electric power to be applied to the heating elements based on the result obtained from the detection. In the described ink jet head driving device, a transistor is adopted as a temperature detecting element, that can be used also as a heating element, to control temperature.

Another ink jet head driving device is disclosed in Japanese Laid-Open Patent Application No. 309832/1993 (Tokukaihei 5-309832), wherein a temperature of the heated portion is detected by a temperature detecting element, and based on the result obtained from the detection, the discharge state of the ink is determined. In such ink jet head element, the temperature characteristics vary depending on whether or not the ink is being discharged. Here, the discharge state of the ink jet head element is determined based on differences in temperature characteristics.

In the former ink jet head driving device of Japanese Laid-Open Patent Application No. 125587/1978 (Tokukaisho 53-125587), as the transistor is adopted as a heating element, by utilizing the temperature characteristics of the transistor, the temperature of the heating element (transistor) can be measured directly. However, such device cannot be applied to ink jet printers having integrated heating elements. This is because a complicated process is required to form the heating element by the transistor, and a manufacturing cost would be too high. Besides, as the temperature of the transistor itself becomes considerably high, the transistor itself may be damaged.

On the other hand, in the latter ink jet head driving device of Japanese Laid-Open Patent Application No. 309832/1993 (Tokukaihei 5-309832), detection of the temperature is not performed by the heating element. Namely, the temperature of the heating element is not measured directly, and heat transmitted from the heating element is detected, thereby presenting the problem that an accurate temperature control is difficult to be achieved. Besides, due to an overheating of the heating element, the heating element may be damaged. Besides, it is required to provide the temperature detecting element in the ink jet head element, which increases a manufacturing cost and a size of the apparatus. Furthermore, as the electric power to be applied to the heating element is adjusted based on the detected temperature, such ink jet head driving device cannot be applied to the ink jet printer designed for high speed printing. This is because, in the ink jet printer, it is required to drive the heating element at high frequency of around 10 kHz; however, the described ink jet head driving device cannot detect the change in temperature of the heating element at high speed.

As described, conventional ink jet head driving devices do not provide the solution to such problem of overheating or insufficient heating of the heating element affected by the ambient temperature, a difference in characteristics of the heating elements, etc. Therefore, a development of an ink jet head driving device of improved characteristics that permits an accurate temperature control of the heating elements by driving them at high frequency without suffering from high cost is desired.

SUMMARY OF THE INVENTION

It is therefore an object of the present invention to provide an ink jet printer designed for high speed printing that can adjust differences in characteristics of heating elements without suffering from a disadvantage of high cost and also to provide a method of adjusting such ink jet printer.

To fulfill at least the above-mentioned object, an example ink jet printer in accordance with the best presently contemplated embodiment of the present invention includes:

plural ink jet head elements for discharging ink;

plural heating sections, respectively provided in the plural ink jet head elements, for generating heat to urge the ink to be discharged; and plural ink jet head driving devices, respectively provided corresponding to the plural ink jet head elements, for respectively controlling electric power to be applied to the corresponding heating sections. The ink jet printer having the described arrangement is characterized in that each ink jet head driving device includes at least the following members (a) through (c) in its heating section:

(a) a power supply section for supplying an electric power to each heating section, (b) a detecting section for detecting an electric value that directly or indirectly represents an electric resistance value of the heating section, and (c) a control section which controls a supply of electric power from the power supply section to the heating section so as to stop the supply when an electric energy detected by the detecting section reaches a predetermined threshold value.

To explain the above-mentioned arrangement, a correlation between the temperature and the resistance value of metal will be explained first. The electric resistance R when temperature is raised by dt is represented by the following formula:

$$R=R_0(1+dt\cdot\alpha),$$

wherein $R_0$ is a resistance of the metal before an application of heat, and $\alpha$ is a temperature coefficient of a resistance.

Here, a current I and a voltage V are respectively represented by the following formulae:

$$I=V/\{R_0(1+dt\cdot\alpha)\}$$

$$V=I\cdot R_0(1+dt\cdot\alpha)$$

Here, as the temperature coefficient $\alpha$ of the electric resistance of metal has a positive value in general, the resistance value increases with a temperature rise.

The described arrangement permits temperature control of the heating section that applies a heat to each ink jet head element utilizing a temperature dependency of the resistance of the metal. Specifically, it is arranged such that an electric value that directly or indirectly represents the resistance value when the heating section is heated to a desired temperature is determined beforehand, and that the electric value that directly or indirectly represents the resistance value is detected by the detecting section. In the described arrangement, when the detecting section detects that the electric energy reaches the threshold value, a supply of electric power from the power supply section to the heating section is stopped by the control section. As a result, the temperature of the heating section can be controlled with accuracy without being affected by changes in ambient temperature or differences in characteristics of the heating sections, etc., thereby suppressing a damage of the heating section or a discharge failure of the ink.

Additionally, the described ink jet printer in accordance with the present invention does not adjust an electric value to be applied to the heating section based on the result obtained from the detection of temperature. Thus, it is applicable to the high frequency pulse driving system of around 10 kHz, thereby permitting high speed printing.

In one preferable modification, the power supply section (a) is a constant voltage source (constant current source) for supplying a constant voltage (constant current), and the detecting section (b) detects a resistance value of the heating section indirectly in a form of a current value (voltage value), and the control section (c) controls a supply of electric power from the power supply section to the heating section so as to stop the supply when the current value (voltage value) detected by the detecting section becomes not more than a prescribed threshold value (not less than a threshold value). As a result, the detecting section measures only the current value flowing through the heating section (voltage value applied to the heating section), thereby achieving a simplified structure thereof.

To fulfill the above-mentioned object, another ink jet printer in accordance with the present invention includes plural ink jet head elements for discharging ink, plural heating sections, respectively provided in ink jet head elements, for generating heat to urge the ink to be discharged, and plural ink jet head driving devices, respectively provided corresponding to ink jet head elements, for controlling electric power to be supplied to the corresponding heating sections. The plural ink jet head driving devices consist of at least one first ink jet head driving device and at least one second ink jet head driving device.

The first ink jet head driving device includes at least the following members (d) through (f):

(d) a first power supply section for supplying electric power to a corresponding heating section, (e) a detecting section for detecting an electric value representing directly or indirectly an electric resistance value of the corresponding heating section, and (f) a first control section for controlling a supply of electric power from the first power supply section to the heating section so as to stop the supply when an electric value detected by the detecting section reaches a predetermined threshold value.

On the other hand, the second ink jet head driving device includes at least the following members (g) and (h):

(g) a second power supply section for supplying an electric power to a corresponding heating section, and (h) a second control section for controlling a supply of electric power from the second power supply section to the heating section so as to stop the supply based on a result obtained from the detection in the detecting section of the first ink jet head driving device.

In the described arrangement, among plural ink jet head driving devices stored in the ink jet printer, at least one ink jet head driving device is designed for the first ink jet head driving device including the detecting section, and the rest of the plural ink jet head driving devices are designed for the second ink jet head driving devices without including the detecting section. The second ink jet head driving device supplies electric power to the heating section based on a result obtained from the detection of the detecting section provided in the first ink jet head driving device. Accordingly, temperature of all the heating sections provided in respective ink jet head driving devices can be controlled with accuracy, and thus the discharge of ink from the ink jet head elements to the printing material can be controlled with accuracy. Additionally, as the need of providing the detecting section for all of the ink jet head driving devices is eliminated, a simplified structure of the device can be achieved.

To fulfill the above-mentioned object, a still another ink jet head printer in accordance with the present invention includes plural ink jet head elements for discharging ink, plural heating sections, provided in respective ink jet head elements, for generating heat to urge the ink to be discharged, plural ink jet head driving devices, respectively provided corresponding to the ink jet head elements, for controlling electric power to be supplied to the corresponding heating sections and a storage section for storing an electric energy to be supplied to each heating section. Each ink jet head driving device includes at least the following members (i) and (j):

(i) a power supply section for applying electric power to a corresponding heating section, and (j) a control section for controlling a supply of electric power such that an electric energy to be supplied to an objective heating section to be controlled is equal to an electric power to be applied to the objective heating section stored in the storage section.

According to the described arrangement, the electric energy to be supplied to the corresponding heating section is stored in the storage section. The electric energy is determined for each heating section, and the ink jet head driving device applies heat to the heating section by the electric energy. Accordingly, the respective characteristics of the ink jet heads can be adjusted without suffering from differences in characteristics of the heating sections.

Various methods of adjusting the electric energy to be stored in the storage section of the ink jet printer are available, and, for example, the following method which includes the steps (k) through (n) may be adopted:

(k) determining a temperature of each heating section at which the ink can be discharged without being destroyed, (l) calculating a threshold resistance value obtained when the heating section is at the temperature determined in the first step based on a temperature dependency of a resistance value of the heating section;

(m) calculating an electric energy required for setting the resistance value of each heating section equal to the threshold resistance value determined in the step (l); and (n) storing an electric energy in a storage section to be applied to each heating section that is calculated in the step (m).

According to the described method, when determining the electric energy to be stored in the storage section, it is required to measure only the resistance value of each heating section, and the need of measuring the temperature of each heating section is eliminated. As a result, the electric energy to be stored in the storage section can be determined with ease.

For a fuller understanding of the nature and advantages of the invention, reference should be made to the ensuing detailed description taken in conjunction with the accompanying drawings.

BRIEF DESCRIPTION OF THE DRAWINGS

FIG. 3(*b*) is a waveform diagram showing a drive voltage of the heating layer of FIG. 3(*a*).

FIG. 5(*b*) is a waveform diagram showing a drive voltage of the heating layer in accordance with the modification of FIG. 4.

FIG. 7(*b*) is a waveform diagram showing a drive current of the heating layer in accordance with the modification of FIG. 6.

DESCRIPTION OF THE EMBODIMENTS

First Embodiment

The following descriptions will discuss one embodiment of the present invention in reference to FIG. 1 through FIG. 7.

An ink jet printer in accordance with the present embodiment includes plural ink jet head elements. Each ink jet head element includes heating means, and discharges ink using a heat generated from the heating means. Each of the heating means is controlled by a corresponding ink jet head driving device.

Figure 1:
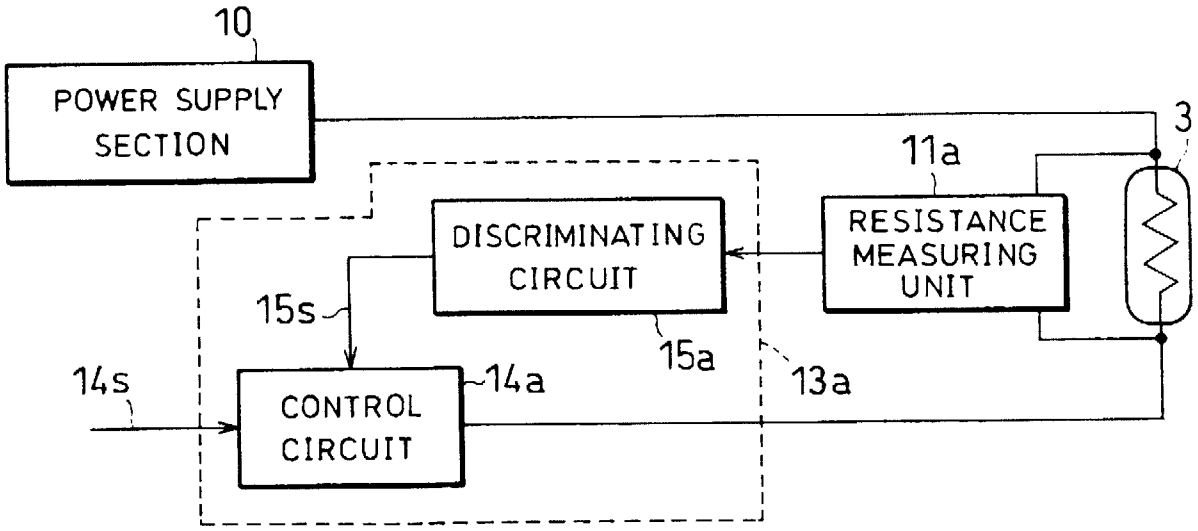
FIG. 1 is a circuit diagram showing one example structure of an ink jet head driving device provided in an ink jet printer in accordance with the first embodiment of the present invention.
Figure 2:
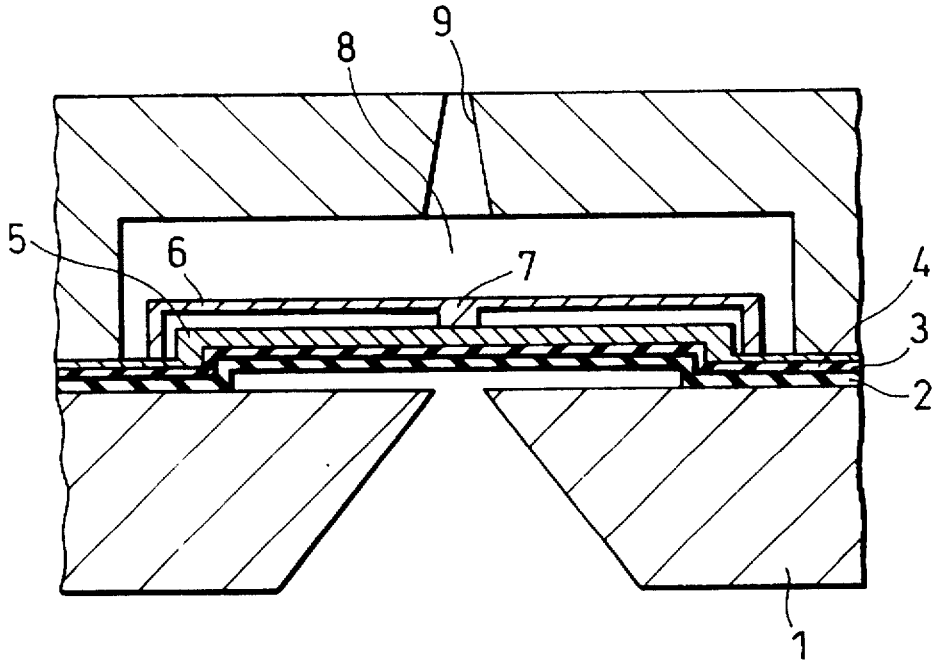
FIG. 2 is a cross sectional view showing a structure of an ink jet head element provided in the ink jet printer of FIG. 1.
Figures 3A, 3B:
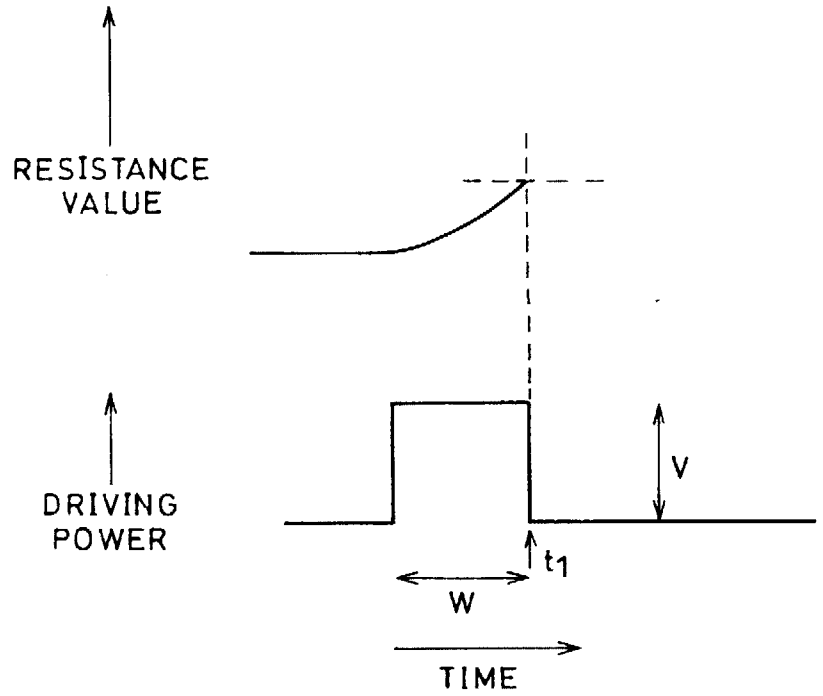
FIG. 3(*a*) is a graph showing a change in resistance value with time of a heating layer under a constant voltage in accordance with the first embodiment shown in FIG. 1.

FIG. 1 shows a configuration of one example of the ink jet head driving device, and FIG. 2 shows a cross sectional view of the ink jet head element.

The structure of the ink jet head element will be explained in reference to FIG. 2. The ink jet head element includes a silicone substrate 1, whereon a first insulating layer 2, a heating layer 3 (heating means), a second insulating layer 4, a buckling member 5 and a diaphragm 6 are formed. The diaphragm 6 and the buckling member 5 are joined together by means of a central portion 7. Further, on an upper surface of the diaphragm 6, formed is an ink chamber 8 which is linked to a nozzle 9.

In the present embodiment, it is preferable that a silicone dioxide with a thickness in a range of from 50 μm to 500 μm is adopted for the first insulating layer 2 and the second insulating layer 4. Further, it is preferable to adopt a nickel layer with a thickness in a range of from 10 μm to 500 μm for the heating layer 3, and that the buckling member 5 and the diaphragm 6 are made of nickel.

Next, the operation of the ink jet head element will be explained. When performing a printing operation on a printing material by discharging thereon an ink, the heating layer 3 generates heat by applying thereto a current. The resulting heat generated from the heating layer 3 is transmitted to the buckling member 5, and the buckling member 5 is expanded by the thermal expansion, thereby generating a compressive stress in the buckling member 5. When the compressive stress exceeds the limit, the buckling member 5 deforms in a direction perpendicular to the silicone substrate 1. This, in turn, deforms the diaphragm 6. Further, such deformation of the diaphragm 6 would reduce the volume of the ink chamber 8, thereby discharging ink from the inside of the ink chamber 8 through the nozzle 9.

The described heat treatment to be applied to the heating layer 3 is controlled by the corresponding ink jet head driving device shown in FIG. 1. In the circuit shown in FIG. 1, the heating layer 3 generates heat by applying thereto a constant voltage V shown in FIG. 3(*b*). During the heating treatment, the resistance value of the heating layer 3 shows a change shown in FIG. 3(*a*). Namely, as time elapses after applying a voltage, the resistance value increases. This is because by a heat treatment with an application of voltage, the resistance value of the heating layer 3 made of metal increases as the temperature thereof is raised.

The ink jet head driving device of the ink jet printer in accordance with the present embodiment is arranged such that the electric power to be applied to the heating layer 3 is controlled based on the described characteristics of the respective heating layers 3 to adjust the temperatures of the heating layers 3. Specifically, a correlation between temperature and resistance value of each heating layer 3 is determined beforehand, and a resistance value (threshold resistance value) of the heating layer 3 when the heating layer 3 is heated to a temperature at which an ink can be discharged without destroying the heating layer 3 is calculated beforehand. Then, when the ink is to be discharged, the resistance value of the heating layer 3 is detected. As a result of detection, if the resistance value shows the threshold resistance value, the application of the heat is stopped.

An operation of the ink jet head driving device will be explained in reference to FIG. 1.

As shown in FIG. 1, the ink jet head driving device includes a resistance measuring unit Ha (detection means), a power supply section 10 (power supply means) that is a constant voltage source, and control means 13*a* which is composed of a control circuit 14*a* and a discriminating circuit 15*a*.

Upon receiving a printing signal 14*s*, the control circuit 14*a* controls the electric power to be supplied from the power supply section 10 to the heating layer 3. The resistance measuring unit 11*a* measures a resistance value of the heating layer 3 and outputs the resistance value to the discriminating circuit 15*a*. When the resistance value reaches the threshold value (a value shown by the dotted line in FIG. 3(*a*)), the discriminating circuit 15*a* outputs a discriminating signal 15*s* to the control circuit 14*a*. Then, when confirming the input of the discriminating signal 15*s*, the control circuit 14*a* stops the supply of electric power from the power supply section 10, thereby determining a pulse width W of the voltage to be supplied to the heating layer 3.

According to the ink jet head driving device, the electric power to be supplied to the heating layer 3 is controlled so as to accurately control the target temperature of the heating layer 3.

As described, the ink jet head printer in accordance with the present embodiment is arranged such that the electric power to be supplied to each heating layer 3 (heating means) is adjusted so as to control the temperature thereof, and thus an insufficient heating or overheating of the heating layer 3 due to changes in ambient temperature or differences in characteristics of the heating layers 3 can be prevented. As a result, the damage of the heating element and the discharge inferior of the ink can be suppressed. Furthermore, without special temperature detection means, the electric power to be supplied based on the resistance value of the heating layer 3 can be adjusted. As a result, the ink jet printer in accordance with the present invention can be applied to the high speed pulse driving of around 10 kHz, thereby permitting high speed printing.

Here, the power supply section 10 is not limited to the constant voltage source, and a constant current source or the source of variable voltage or current type may be equally adopted.

Figure 4:
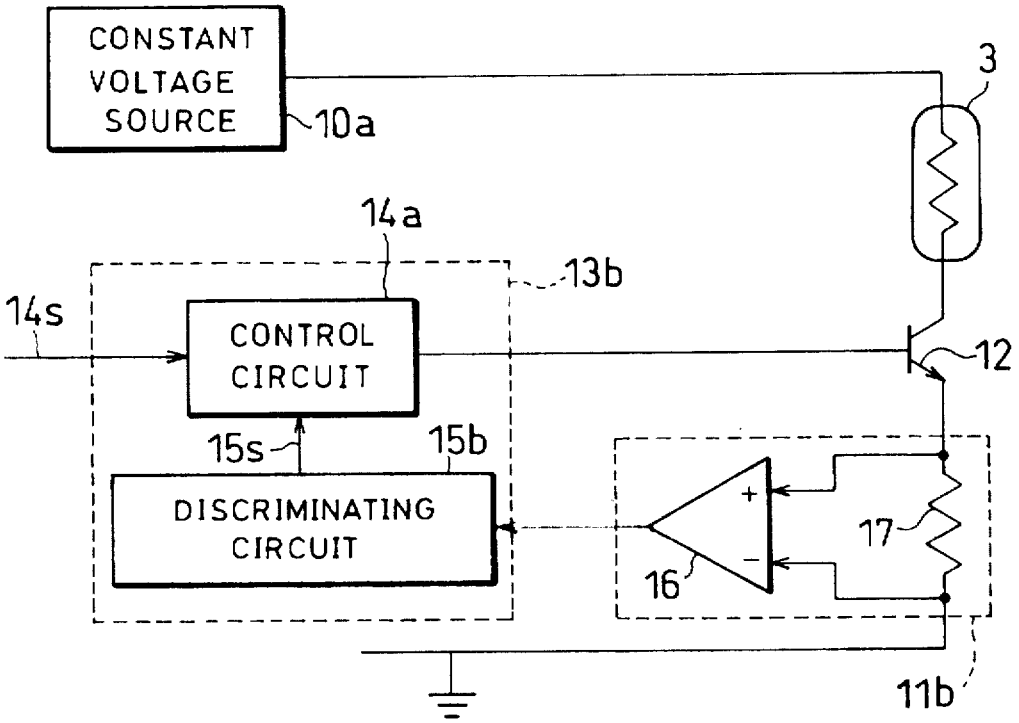
FIG. 4 is a circuit diagram showing one modification of the structure of the ink jet head driving device in accordance with the first embodiment.

FIG. 4 is a circuit diagram showing another example of the ink jet head driving device provided in the ink jet printer. Here, members having the same functions as those shown in FIG. 1 will be designated by the same reference numbers and thus the descriptions thereof shall be omitted here.

The ink jet head driving device includes a constant voltage source 10*a* (power supply means), detection means 11*b* which is composed of an amplifying circuit 16 and a dummy resistance 17, control means 13*b* composed of a control circuit 14*a* and a discriminating circuit 15*b*, and a drive transistor 12.

Figure 5A:
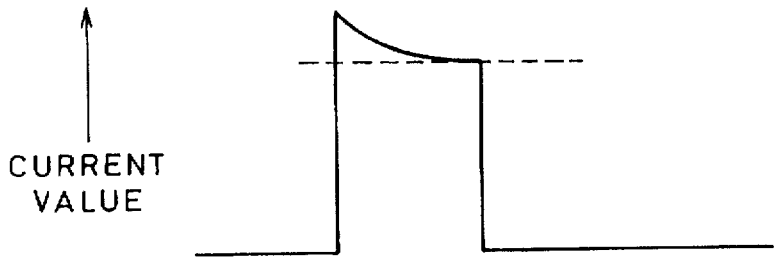
FIG. 5(*a*) is a graph showing a change in current value with time of the heating layer in accordance with the modification of FIG. 4.
Figure 5B:
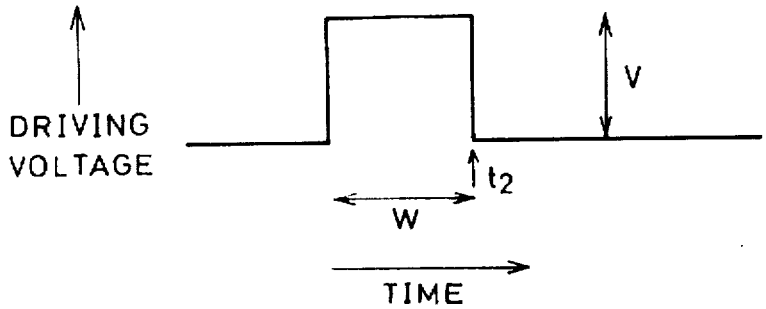

In this circuit, the heating layer 3 generates heat under an applied constant voltage V shown in FIG. 5(*b*). In this state, when monitoring the current flowing through the heating layer 3, the current shows the waveform of FIG. 5(*a*). Namely, although the current starts flowing with an application of pulse voltage, as time passes, the current value reduces. This is because, when the heating layer 3 is heated by applying thereto a voltage, the electric resistance value of the heating layer 3 made of metal gradually increases with a temperature rise.

The ink jet head driving device controls electric power to be supplied to respective heating layers 3 utilizing the described characteristics of current flowing through respective heating layers 3. Specifically, a correlation between the temperature of the heating layer 3 and the current flowing through the heating layer 3 is checked beforehand (under constant voltage supply), a current value (threshold current value) of the heating layer 3 that is heated to a temperature at which the ink can be discharged without being destroyed is calculated beforehand, and the application of heat to the heating layer 3 is stopped when the current value reaches the threshold current value.

In reference to FIG. 4, an operation of the ink jet head driving device will be explained. Here, members having the same functions as the circuit shown in FIG. 1 will be designated by the same reference numerals, and thus the explanations thereof shall be omitted here.

In the circuit, a current applied from the constant voltage source 10*a* is applied to the dummy resistor 17 through the driving transistor 12. The amplifying circuit 16 is provided so as to amplify a potential difference across the dummy resistor 17, and outputs the resulting potential difference to the discriminating circuit 15*b*. Then, the discriminating circuit 15*b* outputs a discriminating signal 15*s* to the control circuit 14*a* when the potential difference becomes not more than a predetermined value, i.e., when the current value flowing through the heating layer 3 becomes not more than the threshold current value (a value shown by the dotted line in FIG. 5(*a*)) at $t_2$ shown in FIG. 5(*b*).

In the ink jet head driving device having the described arrangement, the detection means 11*b* measures only the value of the current flowing through the heating layer 3, and thus a simplified structure can be achieved as compared to the ink jet head driving device shown in FIG. 1.

Figure 6:
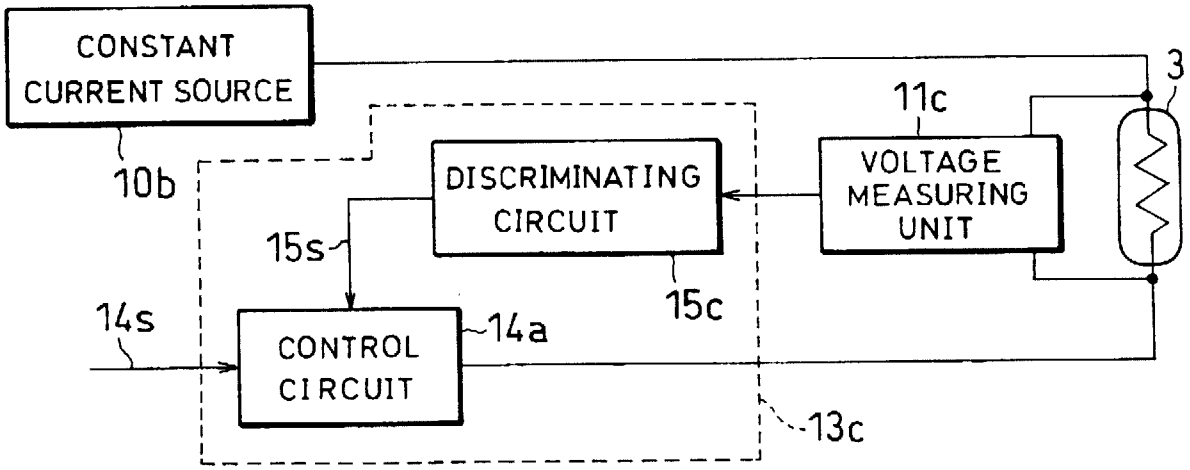
FIG. 6 is a circuit diagram showing another modification of the structure of the ink jet head driving device in accordance with the first embodiment.

For the power supply means, the constant current source 10*b* may be adopted in replace of the constant voltage source 10*a*. FIG. 6 is a block diagram illustrating the structure of the ink jet head driving device. Here, members having the same function as those shown in FIG. 1 will be designated by the same reference numerals, and thus the descriptions thereof shall be omitted here.

The ink jet head driving device includes a constant current source 10*b* (power supply means), a voltage measuring unit 11*c* (detection means), and control means 13*c* composed of a control circuit 14*a* and a discriminating circuit 15*c*.

Figure 7A:
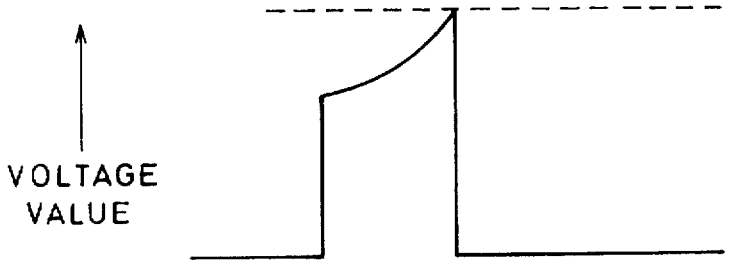
FIG. 7(*a*) is a graph representing a change in time of a voltage value of a heating layer in accordance with the modification of FIG. 6.
Figure 7B:
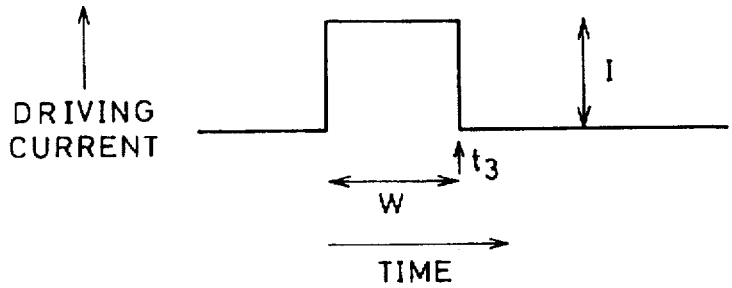

In the circuit having the described arrangement, the heating layer 3 generates heat under an applied constant current I shown in FIG. 7(*b*). Here, when monitoring a voltage to be applied to the heating layer 3, a voltage shows a waveform of FIG. 7(*a*). Namely, when the constant current flows into the heating layer 3, as shown in FIG. 7(*a*), the voltage value increases as time passes. This is because, when an application of heat to the heating layer 3 is started by applying thereto a current, the electric resistance value of the heating layer 3 made of metal increases as temperature thereof is raised.

The ink jet head driving device is arranged so as to control the electric power to be supplied to the corresponding heating layers 3 utilizing the described characteristics of the voltage to be applied to the heating layers 3. Specifically, a correlation between temperature of the heating layer 3 and a voltage to be applied to each heating layer 3 is determined beforehand (under an applied constant current), and a voltage value (threshold voltage) to be applied to the heating layer 3 when the heating layer 3 is heated to a temperature at which an ink can be discharged without being destroyed is calculated beforehand. Then, when discharging the ink, the voltage value applied to the heating layer 3 is detected, and when the voltage value shows the threshold voltage value, the application of heat to the heating layer 3 is stopped.

In reference to FIG. 6, an operation of an ink jet head driving device will be explained. Here, members having the same function as the circuit shown in FIG. 1 will be designated by the same reference numerals, and thus the descriptions thereof shall be omitted here.

Upon receiving a printing signal 14*s*, the control circuit 14*a* controls the constant current source 10*b* so as to start the supply of the electric power. Then, the voltage measuring unit 11*c* detects a voltage to be applied to the heating layer 3, and outputs the result to the discriminating circuit 15*c*. When the detected voltage becomes not less than the threshold voltage value (a value shown by the dotted line in FIG. 7(*a*)) at time $t_3$ shown in FIG. 7(*b*), the discriminating circuit 15*c* outputs the discriminating signal 15*s* to the control circuit 14*a* so as to stop the application of heat.

According to the ink jet head driving device of the described arrangement, by adopting the constant current source 10*b* as the power supply means, power consumption can be reduced without using the dummy resistor 17 unlike the ink jet head driving device shown in FIG. 4.

In the present invention, a circuit in the ink jet head driving device is not limited to the circuit shown in FIG. 1, FIG. 4 and FIG. 6, and any circuit which applies electric power to the heating layer 3 by monitoring an electric value that directly or indirectly represents the resistance value may be adopted.

Second Embodiment

Figure 8:
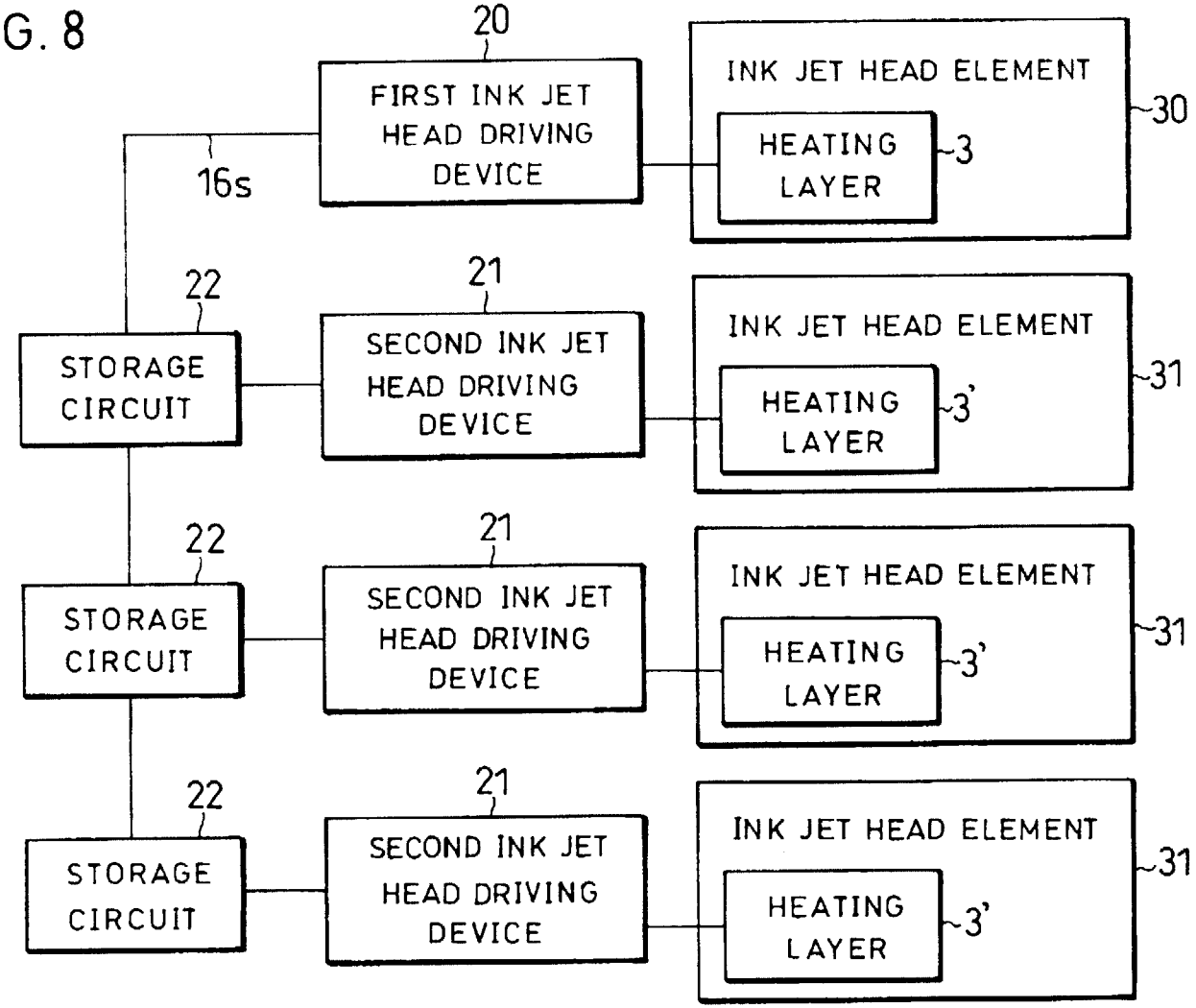
FIG. 8 is a block diagram showing a structure of one block of the ink jet printer in accordance with the second embodiment of the present invention.
Figure 9:
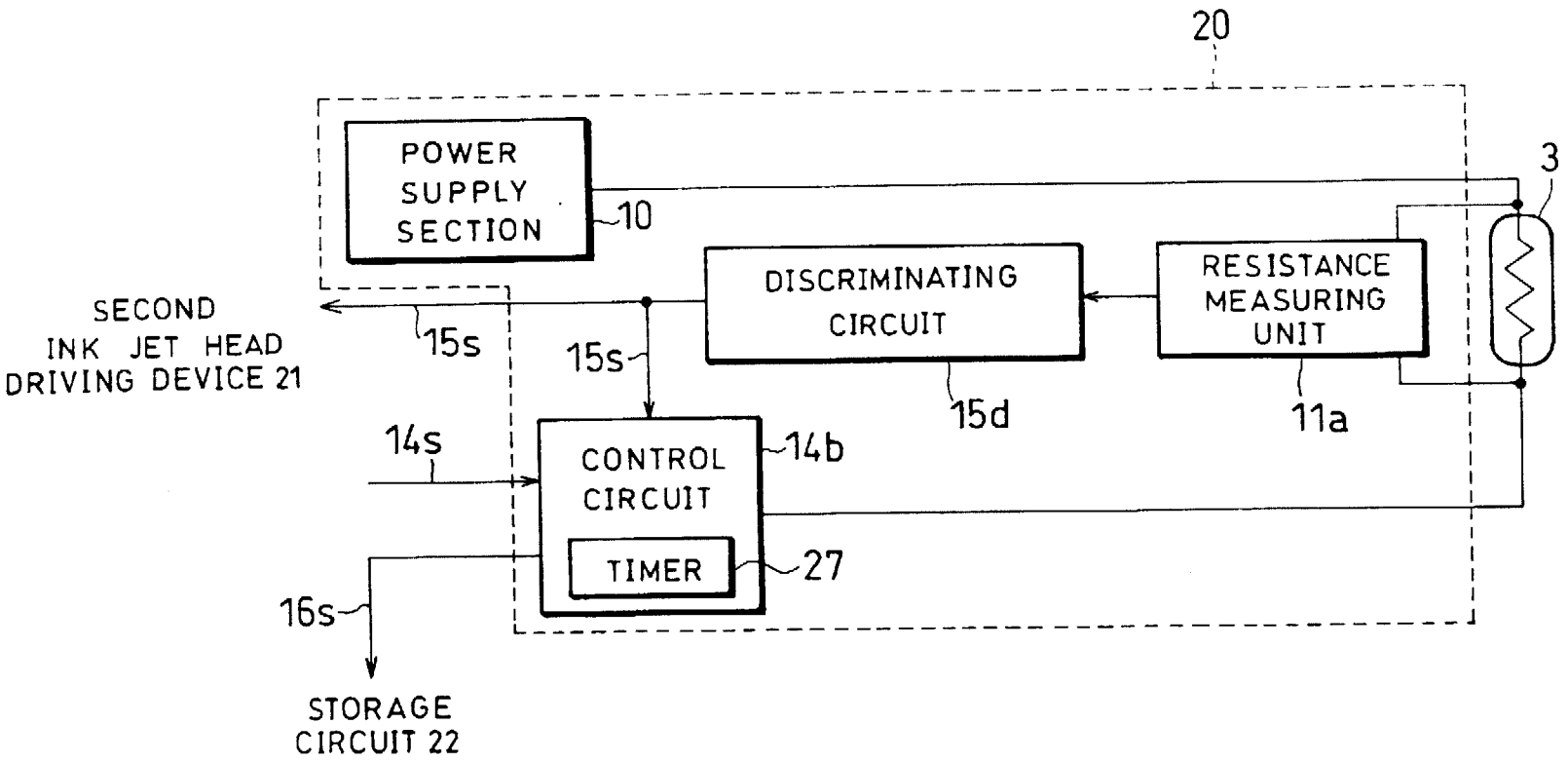
FIG. 9 is a circuit diagram showing one example of the configuration of the first ink jet head driving device in accordance with the second embodiment.
Figure 10:
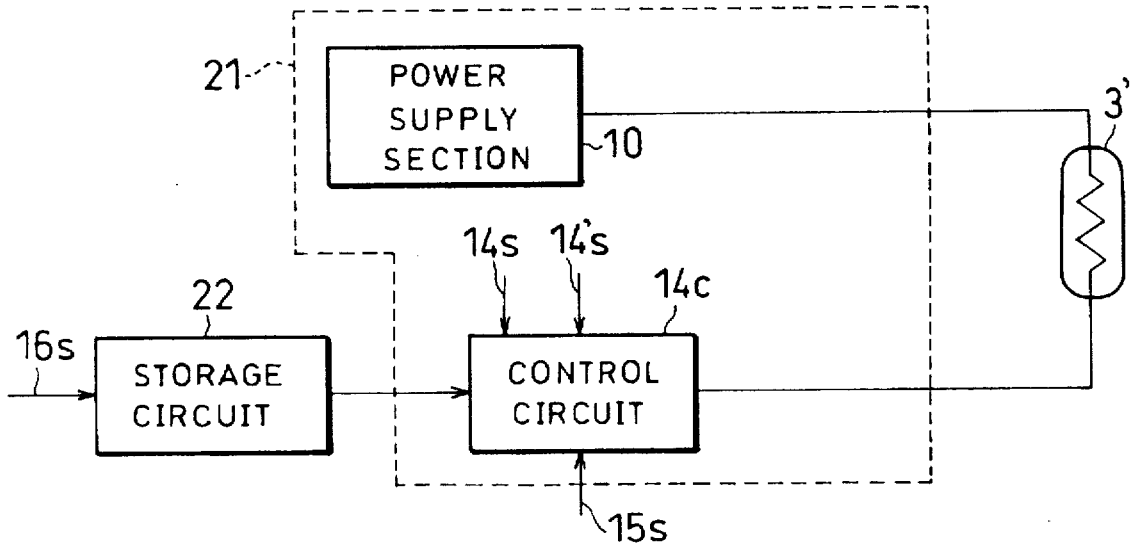
FIG. 10 is a circuit diagram showing one example of the structure of the second ink jet head driving device in accordance with the second embodiment.

The following descriptions will discuss another embodiment of the present invention in reference to FIG. 8 through FIG. 10. For convenience in explanations, members having the same function as the aforementioned embodiment will be designated by the same reference numerals, and thus the descriptions thereof shall be omitted here.

An ink jet printer in accordance with the present embodiment includes plural ink jet head elements respectively including single heating means. Further, each heating means is driven by a corresponding single ink jet head driving device.

The plural ink jet head elements are divided into blocks in such a manner that each block includes four ink jet head elements.

FIG. 8 is a block diagram showing a structure of one block. As shown in FIG. 8, an ink jet head element 30 is driven by the first ink jet head drive unit 20, and the remaining three ink jet head elements 31 are driven by the corresponding second ink jet head driving devices 21.

The first ink jet head driving device 20 includes the detection means, while the second ink jet head 21 does not include the detection means and performs the temperature control of the heating means by utilizing the result obtained from the detection by the detection means of the first ink jet head driving device. Namely, based on the result obtained from the detection of the single detection means provided within one block, the electric power to be applied to the plural (four) heating means is determined.

FIG. 9 is a block diagram showing an example of a structure of the first ink jet head driving device 20. Here, members having the same function as those shown in FIG. 1 will be designated by the same reference numerals, and thus the descriptions thereof shall be omitted here.

The ink jet head driving device 20 includes a power supply section 10 for supplying electric power to the heating layer 3, a resistance measuring unit 11*a*, a discriminating circuit 15*d* and a control circuit 14*b* for a supply of electric power to the heating layer 3 based on a discriminating signal 15*s* from the discriminating circuit 15*d*.

The control circuit 14*b* is provided with a timer 27 (timer means) and measures a time required from an input of a printing signal 14*s* to an input of a discriminating signal 15*s* by a timer, and the resulting time information 16*s* is outputted to a storage circuit 22.

The discriminating circuit 15*d* sends a discriminating signal 15*s* to not only the control circuit 14*b* of the first ink jet head driving device 20 but also to control circuits 14*c* of all the second ink jet head driving devices 21 in the block.

FIG. 10 is a block diagram showing an example of the structure of the second ink jet head driving device. Here, members having the same function as those shown in FIG. 1 will be designated by the same reference numerals, and thus the descriptions thereof shall be omitted here.

The second ink jet head driving device 21 is composed of a power supply section 10 and a control circuit 14*c* which controls a supply of electric power to the heating layer 3'.

As described, the printing signal 14*s*, the discriminating signal 15*s* and the printing signal 14'*s* corresponding to the second ink jet head driving device are inputted to the control circuit 14*c*.

To the storage circuit 22, inputted is a signal 16*s* having the information obtained in a predetermined time of the electric power supplied from the control circuit of the first ink jet head driving device, and the information is renewed to be stored in the storage circuit every time the first ink jet head driving device is driven.

The operation of the second ink jet head drive unit 21 in the case where both the first ink jet head driving device 20 and the second ink jet head driving device 21 are driven will be explained. Upon receiving both the printing signals 14*s* and 14'*s*, the control circuit 14*c* recognizes that both the first ink jet head driving device 20 and the second ink jet head driving device 21 are driven.

The control circuit 14*c* of the second ink jet head driving device controls the power supply section 10 so as to start the supply. Then, at a timing of inputting the discriminating signal 15*s* from the first ink jet head driving device 20, the control circuit 14*c* controls the power supply section 10 so as to stop the supply.

Next, the operation of the second ink jet head driving device in the case where only the second ink jet head driving device 21 is driven without driving the first ink jet head driving device 20 will be explained. Here, only the printing signal 14'*s* is inputted to the control circuit 14*c*, and the printing signal 14*s* is not inputted, thus the control circuit 14*c* determines that only the second ink jet head driving device 21 is driven. In this case, the control circuit 14*c* is activated based on the signal 16*s* stored in the storage circuit 22. Namely, the second ink jet head driving device 21 is activated under the same condition as when driving the first ink jet head driving device 20.

According to the ink jet printer in accordance with the present embodiment, a detection circuit for measuring the resistance value of the heating layer is not required in every ink jet head driving device which drives the ink jet head element, and the detection circuit is provided in only one ink jet head driving device within the block. Generally, the ink discharge portion of the ink jet printer has a size of 10 mm in square, and thus temperature control of the entire apparatus can be performed with accuracy only by detecting the temperature of each block. As a result, in the ink jet printer of the present embodiment, an accurate temperature control of the heating layer 3 and the heating layer 3' can be performed by the ink jet printer of the present embodiment, thereby suppressing the breakdown of the heating layer 3 and the heating layer 3' or a discharge inferior of the ink. Additionally, as compared to the case where the detecting circuits are provided in all of the ink jet head driving devices, a simplified structure and a reduction in cost can be achieved. According to the described arrangement, it is permitted to drive only the second ink jet head drive unit, and in this case, an operation of detecting a resistance value by a detection circuit to be compared with the threshold resistance value can be omitted, thereby permitting a high speed printing.

The ink jet printer in accordance with the present embodiment is not limited to the arrangement shown in FIG. 8, and any arrangement where the second ink jet head driving device 21 is activated based on the result of detection in the ink jet head drive device 20 may be adopted. Additionally, the power supply section 10 may be a current or voltage variable type.

One example of the modification may have the following structure: the power supply section 10 is a constant voltage source 10*a* (constant current source 10*b*), detection means is a circuit for detecting a current (voltage) of the heating layer, and the control mean adjusts the electric power to be supplied to the heating layer when the current (voltage) value becomes not more than (not less than) the threshold value.

In the described preferred embodiment, each block contains four ink jet head elements; however, the number of the ink jet head elements contained in each block is not limited.

Third Embodiment

Figure 11:
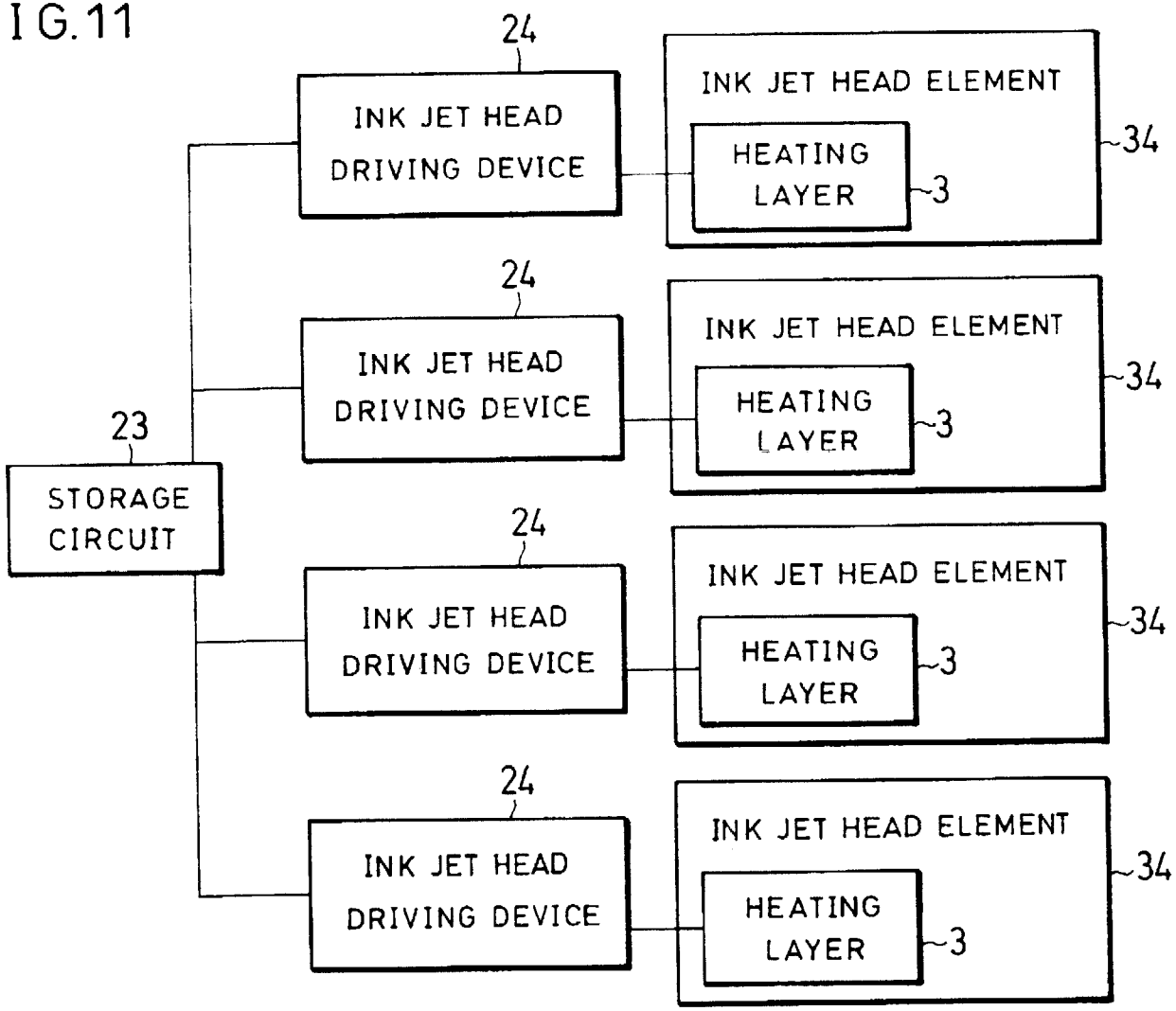
FIG. 11 is a block diagram showing a structure of an ink jet head driving device in accordance with the third embodiment of the present invention.
Figure 12:
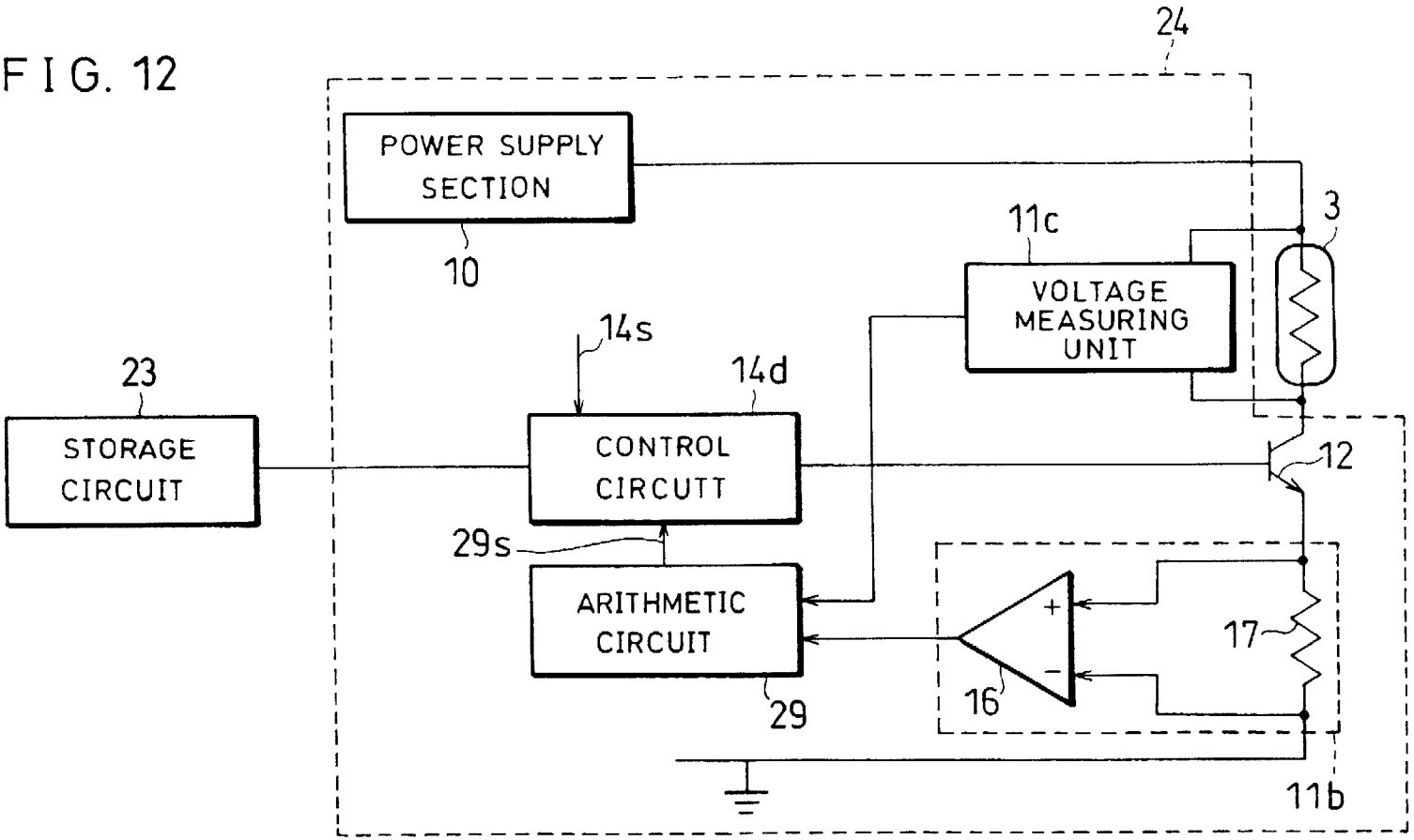
FIG. 12 is a circuit diagram showing a structure of the ink jet head driving device in accordance with the third embodiment.

The following descriptions will discuss still another embodiment of the present invention in reference to FIG. 11 and FIG. 12. For convenience in explanations, members having the same function as the aforementioned embodiment will be designated by the same reference numerals, and thus the descriptions thereof shall be omitted here.

FIG. 11 is a block diagram showing a structure of an ink jet printer in accordance with the third embodiment of the present invention. For simplicity in explanations, it is assumed here that the ink jet printer includes four ink jet head elements 34. The ink jet head elements 34 are respectively driven by corresponding ink jet head driving devices 24.

FIG. 12 is a block diagram showing one example of the ink jet head driving device 24 in accordance with the third embodiment. Here, members having the same function as those shown in FIG. 1, FIG. 4 and FIG. 6 will be designated by the same reference numerals, and thus the descriptions thereof shall be omitted here.

The ink jet head driving device 24 includes a heating layer 3 (heating means), a power supply section 10 (power supply means) for supplying electric power to the heating layer 3, and detection means composed of a voltage measuring unit 11*c* and a current measuring unit 11*b*, and control means composed of an arithmetic circuit 29 and a control circuit 14*d*.

Here, for the power supply 10, a constant voltage source, a constant current source, or those of voltage or current variable type may be adopted.

The current measuring unit 11*b* is composed of the dummy resistor 17 and the amplifying circuit 16. The voltage measuring unit 11*c* measures the voltage value to be applied to the heating layer 3, and the current measuring unit 11*b* measures the current value flowing through the heating layer 3 and outputs the information to the arithmetic circuit 29.

The arithmetic circuit 29 can calculate the electric power based on the product of the voltage value and the current value detected by the detection means. Then, the resulting value of the electric power is sent to the control circuit 14*d* as a signal 29*s*.

Upon receiving the printing signal 14*s*, the control circuit 14*d* applies the electric power from the power supply section 10 to the heating layer 3. Then, based on the value of the electric power sent in the form of the signal 29*s*, the electric energy consumed by the heating layer 3 is calculated. Further, the control circuit 14*d* compares the electric energy with the threshold electric energy stored in the storage circuit 23*a*, and if the consumed electric energy becomes not less than the threshold electric energy, the supply of the electric power is stopped.

The storage circuit 23 (storage means) stores therein the electric energy (threshold electric energy) to be applied to each ink jet head driving device 24. The threshold electric energy is set beforehand by a manual input, etc. Among various methods of setting the threshold electric energy, the following method is preferable as the threshold electric energy for each heating layer can be set in the storage circuit 23 with ease.

1̂ First, a temperature of the heating layer 3 at which ink can be discharged without being destroyed is determined;

2̂ A temperature dependency of the resistance value of the heating layer 3 is checked, and the resistance value (threshold resistance value) when the heating layer 3 is heated to a desirable temperature is calculated;

3̂ An electric energy (threshold electric energy) required for the resistance value to reach the threshold resistance value is calculated for each heating layer 3 (each ink jet head driving device 24) by test printing, etc.; and 4̂ The threshold electric energy is stored in the storage circuit 23*a* for each heating layer 3 (each ink jet head driving device 24).

According to an ink jet printer provided with an ink jet head driving device having the described arrangement, when discharging ink from the ink jet head element 34, a threshold electric energy stored in the storage circuit 23*a* is applied to the heating layer 3 by the power supply section 10 and the control circuit 14*d*. Thus, irrespectively of the difference in characteristics among the heating layers 3, the ink can be discharged under stable conditions. Additionally, according to the described method of setting the threshold electric energy, when setting the threshold electric energy to be stored in the storage circuit 23, only the resistance value is monitored without monitoring the temperature of each heating layer 3. Therefore, the threshold electric energy to be stored in the storage circuit 23*a* can be set with ease.

Figure 13:
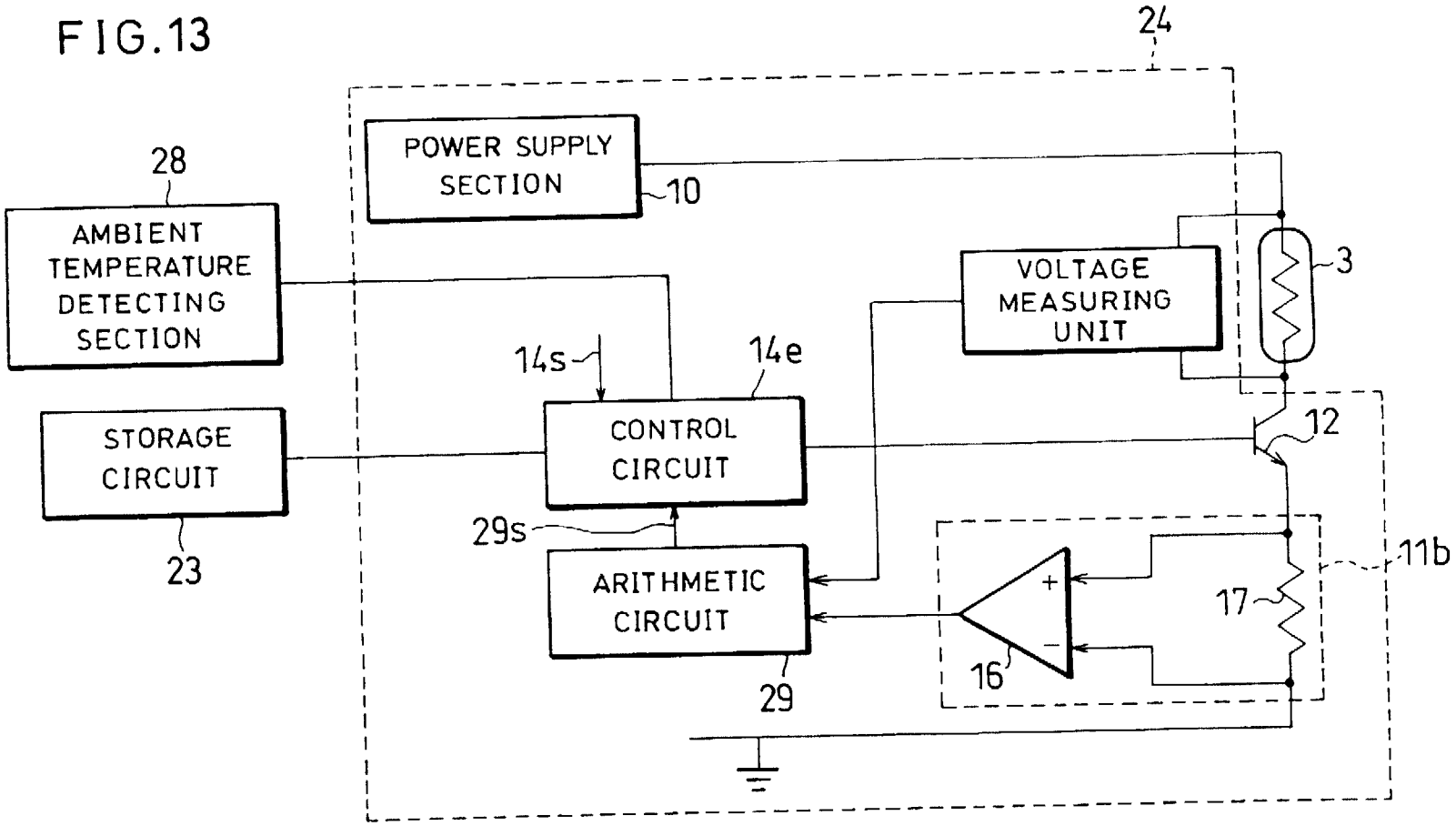
FIG. 13 is a circuit diagram showing a still another example of the structure of the ink jet head driving device in accordance with the third embodiment.

Furthermore, as shown in FIG. 13, by providing an ambient temperature detecting section 28 for detecting the ambient temperature, and arranging such that a control circuit 14*e* varies the threshold electric energy to be stored in the storage circuit 23*a* based on the result obtained from the detection, even when the ambient temperature varies, the ink can be discharged under stable condition.

It should be noted here that the arrangement of the ink jet head driving device 24 is not limited to those shown in FIG. 12 and FIG. 13. Any arrangement which permits the temperature of the heating layer 3 to be controlled by comparing the detected electric energy and the stored threshold electric energy may be adopted.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. An ink jet printer comprising:

plural ink jet head elements for discharging ink;

plural heating means, respectively provided in corresponding ink jet head elements, for discharging ink with an application of heat; and plural ink jet head driving devices, respectively provided corresponding to said plural ink jet head elements, for respectively controlling electric power to be supplied to corresponding said heating means, wherein each of said plural ink jet head driving devices includes power supply means for supplying electric power to each of said plural heating means, detection means for detecting an electric value which directly or indirectly representing an electric resistance value of each of said plural heating means, and control means which controls a supply of electric power from said power supply means to corresponding heating means so as to stop the supply when the electric value detected by said detecting means reaches a threshold value.

2. The ink jet printer as set forth in claim 1, wherein:

said detection means detects an electric resistance value of each heating means as the electric value, and control means controls a supply of electric power from said power supply means to corresponding heating means so as to stop the supply when the electric resistance value detected by said detection means becomes not less that a predetermined threshold value.

3. The ink jet printer as set forth in claim 1, wherein:

said power supply means is a constant voltage source for supplying a constant voltage, said detection means detects a value of a current flowing through corresponding heating means as the electric value, and said control means controls the supply of electric power from said power supply means to corresponding heating means so as to stop the supply when a value of a current detected by said detection means becomes not more than a predetermined threshold value.

4. The ink jet printer as set forth in claim 3, wherein:

said detection means includes a dummy resistor connected to corresponding heating means in series and an amplifying circuit for amplifying a potential difference across said dummy resistor.

5. The ink jet printer as set forth in claim 1, wherein:

said power supply means is a constant current source for supplying a constant current, said detection means detects a value of voltage to be applied to the corresponding heating means as the electric value, and said control means controls the supply of electric power from said power supply means to corresponding heating means so as to stop the supply when a value of a voltage detected by said detection means becomes not less than a predetermined threshold value.

6. The ink jet printer as set forth in claim 1, wherein:

each ink jet head element includes a buckling member, and discharges ink by deforming said buckling member with an application of heat by the corresponding heating means.

7. An ink jet printer comprising:

plural ink jet head elements for discharging ink;

plural heating means, respectively provided in ink jet head elements, for discharging ink with an application of heat; and plural ink jet head driving devices, respectively provided corresponding to said plural ink jet head elements, for respectively controlling electric power to be supplied to corresponding said heating means, said plural ink jet head driving devices consist of at least one first ink jet head driving device and at least one second ink jet head device, said first ink jet head driving device includes first power supply means for supplying electric power to said heating means, detection means for detecting an electric value directly or indirectly representing an electric resistance value of said heating means, and first control means which controls a supply of electric power from said first power supply means to corresponding heating means so as to stop the supply when an electric value detected by said detecting means reaches a threshold value, and said second ink jet head driving device includes second power supply means for supplying electric power to said heating means for supplying electric power to said heating means, and control means for controlling a supply of electric power from said second power supply means to corresponding heating means so as to stop the supply based on a result obtained from the detection by said detection means of said first ink jet head driving device.

8. The ink jet printer as set forth in claim 7, wherein:

said plural ink jet head elements are divided into plural blocks in such a manner that each block contains at least two of said plural ink jet head driving devices, each block contains single first ink jet head driving device and at least one second ink jet driving device which is driven based on a result obtained from a detection by said detection means of said first ink jet head driving device, said second ink jet driving device belonging to a same block as said single first ink jet head driving device.

9. The ink jet printer as set forth in claim 7, wherein:

said first ink jet head driving device includes timer means for measuring a power supply time to said heating means each time a corresponding ink jet head element is driven, each of said second ink jet head driving devices includes storage means for storing a power supply time lastly measured by said first ink jet head driving device, second control means of each second ink jet head driving device controls a supply of electric power to said heating means based on the power supply time stored in said storage means so as to stop the supply when the ink jet head element is not driven by said first ink jet head driving device.

10. The ink jet printer as set forth in claim 7, wherein:

said detection means detects the electric resistance value of said heating means as the electric value, and said first control means stops a supply of electric power from said first power supply means to said heating means when an electric resistance value detected by said detection means becomes not less than a threshold value.

11. The ink jet printer as set forth in claim 7, wherein:

said first and second power supply means are constant voltage sources for supplying a constant voltage, said detection means detects a value of a current flowing through said heating means as the electric value, and said first control means stops a supply of electric power from said first power supply means to said heating means when a value of a current detected by said detection means becomes not more than a predetermined threshold value.

12. The ink jet printer as set forth in claim 7, wherein:

said first and second power supply means are constant current sources for supplying a constant current, said detection means detects a value of a voltage applied to said heating means as the electric value, and said first control means stops a supply of electric power from said first power supply means to said heating means when a value of a voltage detected by said detection means becomes not less than a predetermined threshold value.

13. An ink jet printer comprising:

plural ink jet head elements for discharging ink;

heating means, respectively provided in ink jet head elements, for discharging ink with an application of heat;

plural ink jet head driving devices, provided corresponding to respective said plural ink jet head elements, for respectively controlling electric power to be supplied to said heating means; and storage means for storing an electric energy to be supplied to said heating means, that is selected for each heating means, and each ink jet head driving device includes power supply means for supplying an electric power to corresponding heating means, and control means for controlling a supply of electric power such that the electric energy supplied to the heating means to be controlled that is stored in said storage means is equal to the electric energy supplied to said heating means.

14. The ink jet printer as set forth in claim 13, wherein:

said control means includes detection means for detecting an electric energy supplied to said heating means, and controls a supply of electric power from said power supply means to said heating means so as to stop the supply when the electric energy detected by said detection means reaches an electric energy to be supplied to said heating means that is stored in said storage means.

15. The ink jet printer as set forth in claim 13, further comprising:

temperature detection means for detecting an ambient temperature; and means for adjusting an electric energy stored in said storage means based on a result obtained from a detection of the ambient temperature by said temperature measuring means.

16. A method of adjusting the electric power to be stored in said storage means of the ink jet printer as set forth in claim 13, comprising:

a first step of determining a temperature of said heating means at which the ink can be discharged without being destroyed;

a second step of calculating a threshold resistance value at which said heating means is at the temperature determined in said first step based on a temperature dependency of a resistance value of said heating means;

a third step of calculating an electric energy required for setting the resistance value of each heating means equal to the threshold resistance value determined in said second step; and a fourth step of storing in said storage means the electric energy to be applied to each heating means that is calculated in said third step.

* * * * *